US007466324B2

(12) United States Patent
Chen et al.

(10) Patent No.: US 7,466,324 B2
(45) Date of Patent: Dec. 16, 2008

(54) METHOD OF ADJUSTING THE BRIGHTNESS OF A DISPLAY DEVICE

(75) Inventors: Ying-Hui Chen, Taoyuan (TW); Wen-Hsiung Liu, Neipu Township, Pingtung County (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 540 days.

(21) Appl. No.: 11/089,828

(22) Filed: Mar. 24, 2005

(65) Prior Publication Data

US 2006/0214954 A1 Sep. 28, 2006

(51) Int. Cl.
*G09G 5/10* (2006.01)

(52) U.S. Cl. ..... 345/690; 345/63; 345/77; 345/88; 345/102; 345/211

(58) Field of Classification Search ..... 345/63, 345/72, 77, 83, 88, 102, 211, 690
See application file for complete search history.

(56) References Cited

U.S. PATENT DOCUMENTS 6,559,826 B1 * 5/2003 Mendelson et al. ..... 345/102

* cited by examiner

*Primary Examiner*—Amr Awad
*Assistant Examiner*—Michael Pervan
(74) *Attorney, Agent, or Firm*—J.C. Patents

(57) ABSTRACT

A method of adjusting the brightness of a display device is provided. The method includes providing a plurality of saturated level-adjust voltages to various level adjustments of the display device when the central brightness is saturated. Then, a computation of the saturated level-adjust voltage of each level adjustment is carried out to obtain a display voltage of each level adjustment. Thereafter, a computation of the saturated level-adjust voltage, a common voltage and the display voltage of each level adjustment is carried out to obtain a feed-through voltage for each level adjustment. After that, a computation of the feed-through voltage and the saturated level-adjust voltage of each level adjustment is carried out to obtain a liquid crystal capacitance value for each level adjustment. Finally, a simulation of the liquid crystal capacitance value of each level adjustment is carried out to obtain an optimized level-adjust voltage for each level adjustment.

8 Claims, 5 Drawing Sheets

METHOD OF ADJUSTING THE BRIGHTNESS OF A DISPLAY DEVICE

BACKGROUND OF THE INVENTION

1. Field of the Invention

The present invention relates to a method of adjusting the brightness of a display device. More particularly, the present invention relates to a method of adjusting the brightness of a display device that utilizes brightness-adjusted feed-through voltages to deduce various level-adjust liquid crystal capacitance values so that optimized level-adjust voltages are obtained.

2. Description of the Related Art

The earliest types of dynamic images are documentary movies. Thereafter, with the invention of cathode ray tube (CRT), commercialized television broadcast has become so successful that almost every family has at least a television in their household. With the rapid development of the electronic technologies, CRTs have also been used as desktop monitors in computer systems so that CRTs were almost everywhere for several decades. However, due to the possibility of emitting hazardous radiation from various CRT-based display devices and the bulkiness of the display devices resulting from the electron gun design, CRT-based display devices can hardly be miniaturized, lightened up or scaled up to a larger size.

With the aforementioned problems for CRT, researchers has begun the development of the so-called flat panel display devices. Flat panel display device is a generic term for all display devices having a flat display surface, which includes the liquid crystal display (LCD), the field emission display (FED), the vacuum fluorescent display (VFD), the organic light emitting diode (OLED) and the plasma display panel (PDP). Due to the advantages of a large viewing angle, superior image quality and suitability for size scaling, PDP has a large market potential and is currently adopted in many types of digital televisions.

In the present-day technological level, using simulation software to modify level-adjust voltage in the process of developing new models saves development time as well as cost. In general, the major parameters required by the simulation are related to the pixel design. Aside from the liquid crystal capacitance ($C_{LC}$), other parameters are fixed at the completion of the pixel design. Since the liquid crystal capacitance is related to the parameters of the liquid crystal, the effects due to material properties must be considered.

Different liquid crystals have different transparency rating versus display voltage (T-V) and liquid crystal capacitance versus display voltage (C-V) relations. A conventional twisted nematic (TN) liquid crystal pixel structure has a simpler structure design. Hence, a test cell can be fabricated and liquid crystal injected to measure the T-V and C-V relation of the liquid crystal. Thereafter, the capacitor equation:

$$C = \varepsilon_0 \varepsilon_r \frac{A}{d}$$

can be used to find the liquid crystal capacitance value of the pixel structure. Here, $\epsilon_0$ is the vacuum dielectric constant (a fixed value equals to $8.85e^{-14}$F/cm), $\epsilon_r$ is the liquid crystal dielectric coefficient (different liquid crystal has a different $\epsilon_r$ value), A is the area occupation of the liquid crystal capacitor and d is the separation between liquid crystal cells.

FIG. 8 is a flow diagram showing a conventional method of adjusting the brightness of a display device. In the conventional technique, the curve relating T-V and the curve relating C-V for the liquid crystal have already been measured in the process of fabricating the test cell. First, a computation of the gamma curve is carried out to obtain the transparency rating (T) of each level adjustment (S802). According to the transparency rating-display voltage (T-V) curve, the display voltage corresponding to the transparency rating for each level adjustment is obtained (S804). Thereafter, according to the liquid crystal capacitance value—display voltage curve, the liquid crystal capacitance value ($C_{LC}$) corresponding to the display voltage for each level adjustment is obtained (S806). Finally, a simulation of the liquid crystal capacitance value of each level adjustment is carried out to obtain the best modulated ac driven positive, negative polarity optimized level-adjust voltage for each level adjustment (S808).

At present, the test cell structure of most TN liquid crystal display devices includes, from bottom to top, a glass layer, an indium-tin-oxide (ITO) layer, a LC layer, another indium-tin-oxide (ITO) layer and another glass layer. With the need for larger display panel and more television panels, the application of wide viewing angle technologies is definitely on the rise. However, unlike the simple TN type of display devices, the pixel design in wide viewing angle technologies is more sophisticated. For example, a display device having a multi-domain vertical alignment (MVA) design has bump or slit structures. In the design of such wide viewing angle display device, width, space and height all needs to be considered. In-plane switching mode (IPS) horizontal electric field are some of the major factors that needs to be considered. As a result, there are too many parameters and combinations to render the liquid crystal capacitance value obtained from testing a simple test cell valid.

SUMMARY OF THE INVENTION

Accordingly, at least one objective of the present invention is to provide a method of adjusting the brightness of a display device that utilizes brightness adjusted feed-through voltages to deduce the liquid crystal capacitance value of various level adjustments. Thus, the time and cost for developing a new model is reduced.

At least a second objective of the present invention is to provide a method of adjusting the brightness of a display device that utilizes a simulated variation of the optimized level-adjust voltages so that the positive display voltage is equal to the negative display voltage.

To achieve these and other advantages and in accordance with the purpose of the invention, as embodied and broadly described herein, the invention provides a method of adjusting a display device. The brightness adjustment method includes providing a plurality of saturated level-adjust voltages to various level adjustments of the display device when the central brightness is saturated. Next, a computation of the saturated level-adjust voltage of each level adjustment is carried out to obtain a display voltage for each level adjustment. Thereafter, a computation of the saturated level-adjust voltage, a common voltage and the display voltage of each level adjustment is carried out to obtain a feed-through voltage for each level adjustment. After that, a computation of the feed-through voltage and the saturated level-adjust voltage of each level adjustment is carried out to obtain a liquid crystal capacitance value for each level adjustment. Finally, a simulation of the liquid crystal capacitance value of each level adjustment is carried out to obtain an optimized level-adjust voltage for each level adjustment.

According to the preferred embodiment of the present invention, the brightness adjustment method further comprises computing the display voltage of each level adjustment to obtain a transparency rating for each level adjustment.

According to the preferred embodiment of the present invention, the steps for providing a plurality of saturated level-adjust voltages to various level adjustments of the display device when the central brightness is saturated includes driving the display device with a dc voltage. Then, a common voltage with a fixed value is provided. Thereafter, the saturated level-adjust voltage of each level adjustment is measured.

The present invention also provides an alternative method of adjusting a display device. The brightness adjustment method includes providing a saturated level-adjust voltage to a level adjustment of the display device when the central brightness is saturated. Next, a computation of the saturated level-adjust voltage is carried out to obtain a display voltage. Thereafter, a computation of the saturated level-adjust voltage, a common voltage and the display voltage is carried out to obtain a feed-through voltage. After that, a computation of the feed-through voltage and the saturated level-adjust voltage is carried out to obtain a liquid crystal capacitance value. Finally, a simulation of the liquid crystal capacitance value is carried out to obtain an optimized level-adjust voltage.

According to one preferred embodiment of the present invention, the saturated level-adjust voltage includes a high voltage (Vsh) and a low voltage (Vsl).

In the present invention, brightness adjusted feed-through voltages are used to deduce the liquid crystal capacitance values of various level adjustments. Therefore, various level-adjust voltages can be obtained through a simulation. Moreover, the simulated results are similar to the level-adjust voltages of the last modulation of a circuit. Hence, not only is the time and cost for developing a new model reduced, but the level-adjust voltages are also optimized through the simulated variation. Ultimately, flickering on the display device is reduced and the display quality is improved.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
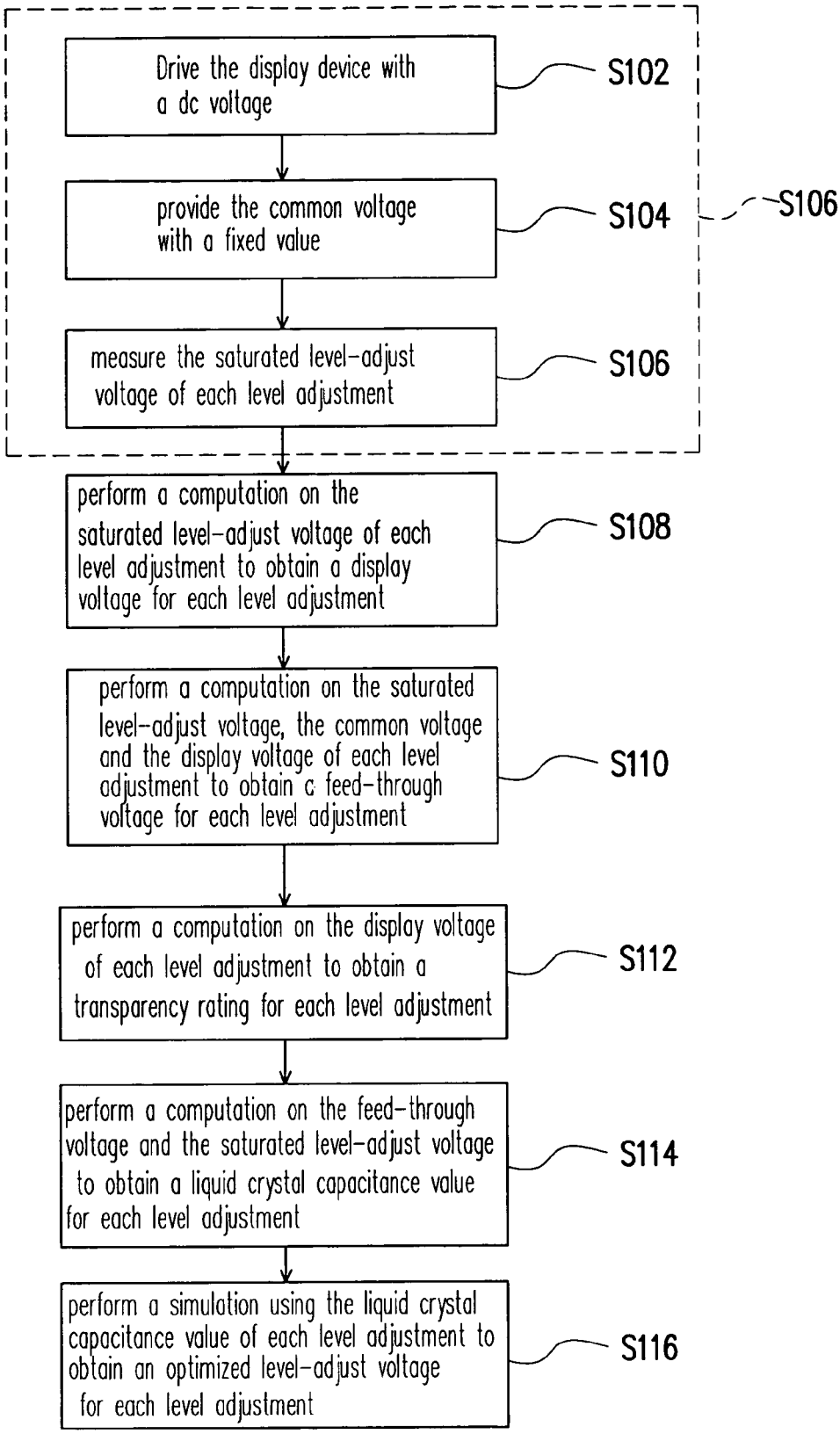
FIG. 1 is a flow diagram showing the steps for adjusting the brightness of a display device according to one preferred embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
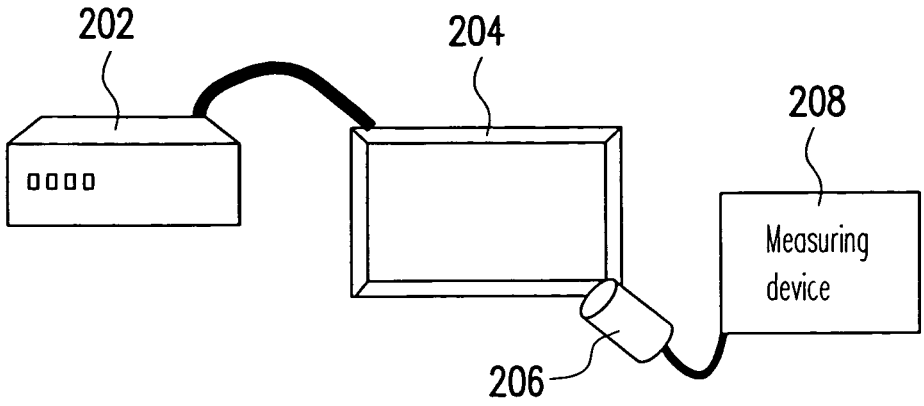
FIG. 2 is a sketch of an instrument for measuring the brightness of a display device according to one preferred embodiment of the present invention.

FIG. 1 is a flow diagram showing the steps for adjusting the brightness of a display device according to one preferred embodiment of the present invention. FIG. 2 is a sketch of an instrument for measuring the brightness of a display device according to one preferred embodiment of the present invention. As shown in FIG. 2, the instrument 20 for measuring brightness includes a signal generator 202, a liquid crystal display panel 204, a measuring end 206 and a measuring device 208. The signal generator 202 can be a power supply and the measuring device 208 can be a computer, for example. However, the signal generator 202 and the measuring device 208 are not limited as such.

As shown in FIGS. 1 and 2, the method of adjusting the brightness of a display device includes providing a plurality of saturated level-adjust voltages to various level adjustments of the display device when the central brightness is saturated (S100). The measurement of the saturated level-adjust voltage includes changing the signal generator 202 from the original method of using an ac voltage to drive the liquid crystal display panel 204 with a new method of using a dc voltage to drive the liquid crystal display panel 204 (S102). In other words, the high voltage (Vsh) of each level adjustment is equal to the low voltage (Vsl).

In the preferred embodiment of the present invention, the saturated level-adjust voltage comprises a high voltage (Vsh) and a low voltage (Vsl).

Thereafter, a fixed-value common voltage is provided to the liquid crystal display panel 204 (S104). Then, the measuring end 206 is used to measure the saturated level-adjust voltage of the liquid crystal display panel 204 when the central brightness is saturated (S106).

Figure 3A:
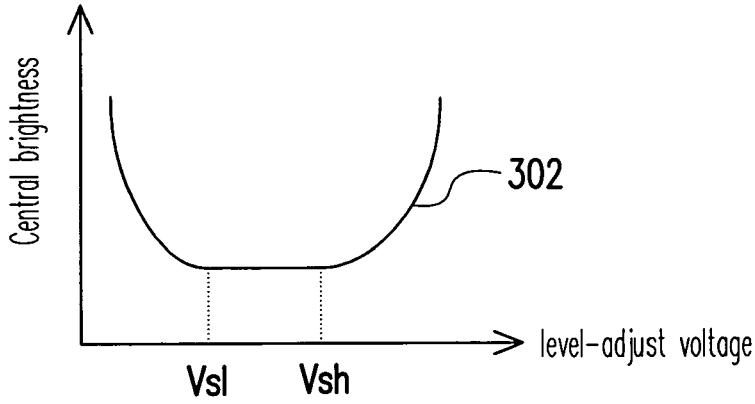
FIG. 3A is a graph showing the black level-adjust brightness result obtained from a measurement of panel's central brightness.

FIG. 3A is a graph showing the black level-adjust brightness result obtained from a measurement of panel's central brightness. A lowest saturated level-adjust voltage is found when measuring the saturated level-adjust voltage of the liquid crystal display panel 204 central brightness. The lowest saturated level-adjust voltage includes the high voltage Vsh and the low voltage Vsl of a black level adjustment.

Figure 3B:
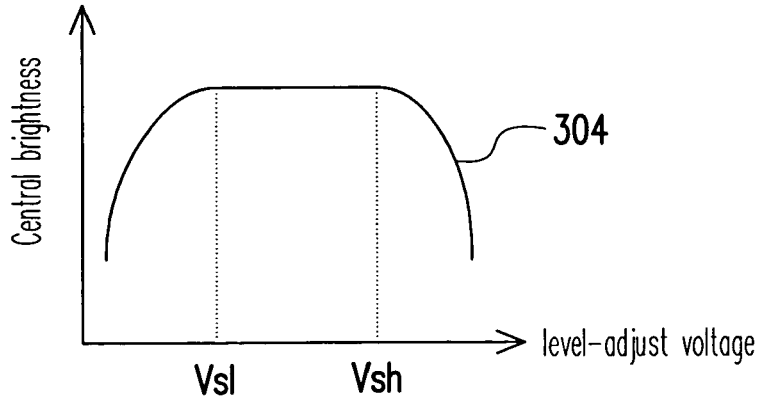
FIG. 3B is a graph showing the white level-adjust brightness result obtained from a measurement of panel's central brightness.

FIG. 3B is a graph showing the white level-adjust brightness result obtained from a measurement of panel's central brightness. A highest saturated level-adjust voltage is found when measuring the saturated level-adjust voltage of the liquid crystal display panel 204 central brightness. The highest saturated level-adjust voltage includes the high voltage Vsh and the low voltage Vsl of a white level adjustment. In a similar way, the high voltage and the low voltage of various other level adjustments can be obtained.

Figure 4:
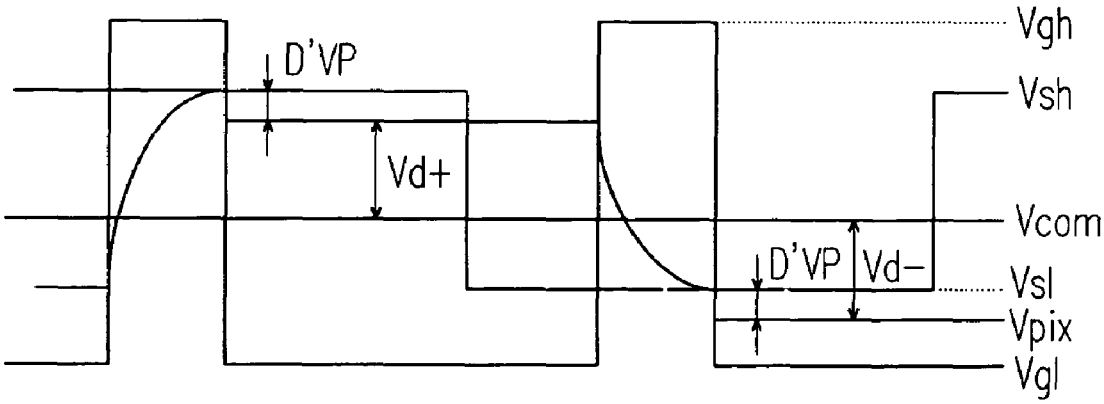
FIG. 4 is a liquid crystal driving waveform according to one preferred embodiment of the present invention.

As shown in FIG. 1, after obtaining the saturated level-adjust voltage of various level adjustments, a computation of the saturated level-adjust voltage (Vsh and Vsl) for each level adjustment is carried out using the formula derived from FIG. 4 to obtain a display voltage (Vd) of each level adjustment (S108). The formulae are:

$$Vsh=Vcom+Vd+D'Vp, \text{ and}$$

$$Vsl=Vcom-Vd+D'Vp$$

Hence, according to the aforementioned formulae, Vd=(Vsh−Vsl)/2

Thereafter, a computation of the saturated level-adjust voltage, the common voltage (Vcom) and the display voltage for each level adjustment is carried out using the two aforementioned formulae to obtain a feed-through voltage (D'Vp) for each level adjustment (S110). Here, the feed-through voltage D'Vp is given by the formula:

$$D'Vp = \frac{Vsh + Vsl}{2} - Vcom.$$

Figure 5:
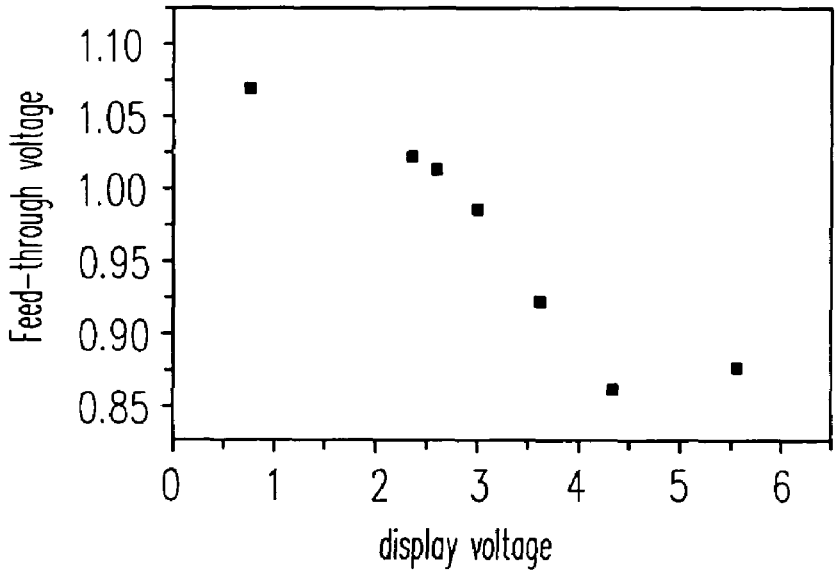
FIG. 5 is a graph showing a feed-through voltage versus display voltage curve according to one preferred embodiment of the present invention.

Hence, according to the feed-through voltage and the display voltage, a relation curve between the two as shown in FIG. 5 is obtained.

Figure 6:
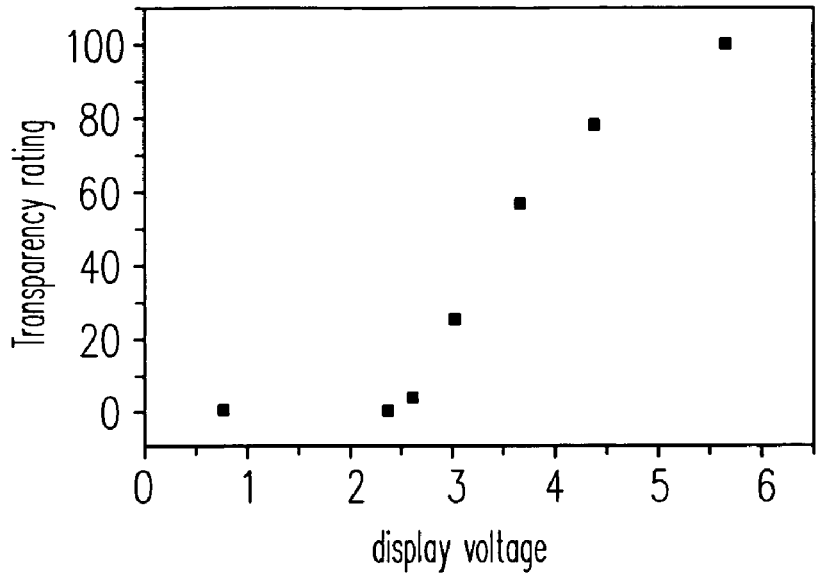
FIG. 6 is a graph showing a transparency rating versus display voltage curve according to one preferred embodiment of the present invention.

Thereafter, the measuring device 208 performs a computation on the display voltage of each level adjustment to obtain the transparency rating of the liquid crystal for each level adjustment (S112). Thus, a curve relating the transparency rating to the display voltage as shown in FIG. 6 is obtained.

Thereafter, a computation of the feed-through voltage and the saturated level-adjust voltage of each level adjustment is carried out to obtain a liquid crystal capacitance value ($C_{LC}$) for each level adjustment (S114). The liquid crystal capacitance value is deduced from the theory of conservation of electric charges represented by the following formula:

$$D'Vp = \frac{Cgd}{C_{LC} + Cs + Cgd} \times (Vgh - Vgl).$$

Figure 7:
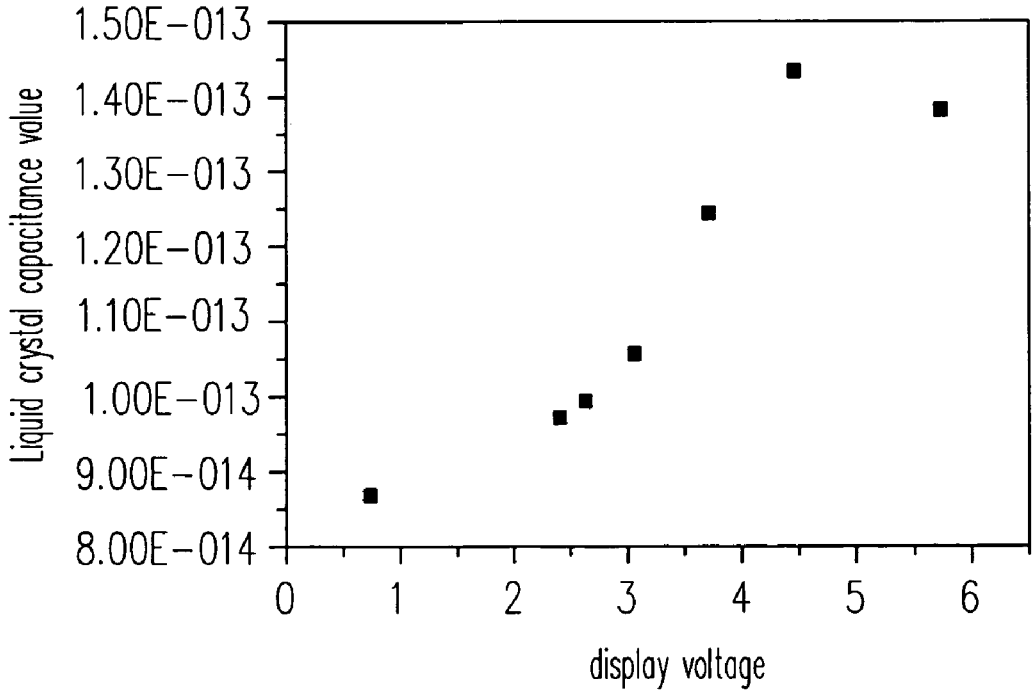
FIG. 7 is a graph showing a liquid crystal capacitance value versus display voltage curve according to one preferred embodiment of the present invention.
Figure 8:
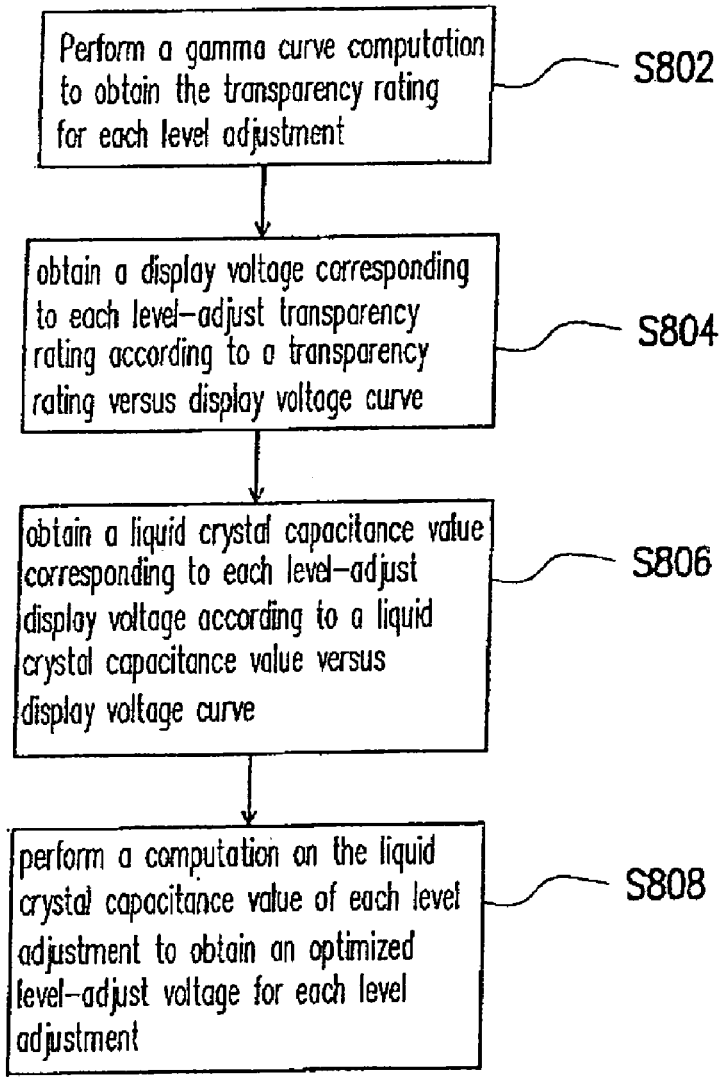
FIG. 8 (PRIOR ART)
FIG. 8 is a flow diagram showing a conventional method of adjusting the brightness of a display device.

Here, D'Vp is the feed-through voltage, Vgh is the high gate voltage, Vgl is the low gate voltage, Cgd is the gate-drain capacitance of a transistor and Cs is the storage capacitance. Therefore, if the values of D'Vp, Vgh, Vgl, Cgd and Cs are known, the liquid crystal capacitance value $C_{LC}$ can be obtained. According to the value of $C_{LC}$ and D'Vp, a liquid crystal capacitance value versus display voltage graph as shown in FIG. 7 is obtained.

In one preferred embodiment of the present invention, the purpose of adjusting the level-adjust voltage is to equalize the display voltage Vd+ and Vd− shown in FIG. 4.

In the present embodiment, after obtaining the liquid crystal capacitance value of each level adjustment, a simulation using the liquid crystal capacitance values can produce an optimized level-adjust voltage for each level adjustment (S116).

In one preferred embodiment of the present invention, after substituting all the aforementioned parameters, the three level-adjust feed-through voltages D'Vp' of the three level adjustments listed in Table 1 are obtained. The feed-through voltages D'Vp obtained through brightness adjustment are also listed out in Table 1.

TABLE 1

| | White level adjusted | Intermediate level-adjusted | Black level-adjusted |
|---|---|---|---|
| D'Vp | 0.875 | 0.99 | 1.07 |
| D'Vp' | 0.815 | 0.990456 | 1.111827 |

From Table 1, it is found that the feed-through voltages obtained through the method of the present embodiment and the feed-through voltage obtained through brightness adjustment are very close to each other.

In summary, brightness adjusted feed-through voltages are used to deduce the liquid crystal capacitance values of various level adjustments. Therefore, various level-adjust voltages can be obtained through a simulation. Moreover, the simulated results are similar to the level-adjust voltages of the last modulation of a circuit. Hence, not only is the time and cost for developing a new model reduced, but the level-adjust voltages are also optimized through the simulated variation. Ultimately, flickering on the display device is reduced and the display quality is improved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of adjusting a brightness of a display device, comprising the steps of:

providing a plurality of saturated level-adjust voltages to various level adjustments of the display device when a central brightness is saturated, wherein the step of providing a plurality of saturated level-adjust voltages to various level adjustments of the display device when the central brightness is saturated comprising:

driving the display device with a dc voltage;

providing a fixed value to the common voltage; and measuring the saturated level-adjust voltage of each level adjustment;

performing a computation of the saturated level-adjust voltage of each level adjustment to obtain a display voltage for each level adjustment;

performing a computation of the saturated level-adjust voltage, a common voltage and the display voltage of each level adjustment to obtain a feed-through voltage for each level adjustment;

performing a computation of the feed-through voltage and the saturated level-adjust voltage of each level adjustment to obtain a liquid crystal capacitance value for each level adjustment; and performing a simulation of the liquid crystal capacitance value of each level adjustment to obtain an optimized level-adjust voltage for each level adjustment.

2. The method of adjusting the brightness level of a display device of claim 1, further comprises performing a computation of the display voltage for each level adjustment to obtain a transparency!rating for each level adjustment.

3. The method of adjusting the brightness level of a display device of claim 1, wherein the saturated level-adjust voltage comprises a high voltage (Vsh) and a tow voltage (Vsl).

4. The method of adjusting the brightness level of a display device of claim 1 is suitable for a liquid crystal display device having a wide viewing angle.

5. A method of adjusting a brightness level of a display device, comprising the steps of:

providing a saturated level-adjust voltage to a level adjustment of the display device when a central brightness is saturated, wherein the step of providing a saturated level-adjust voltage to a level adjustment of the display device when the central brightness is saturated comprising:

driving the display device with a dc voltage;

providing a fixed value to the common voltage; and measuring the saturated level-adjust voltage of the level adjustment;

performing a computation on the saturated level-adjust voltage to obtain a display voltage;

performing a computation on the saturated level-adjust voltage, a common voltage and the display voltage to obtain a feed-through voltage;

performing a computation on the feed-through voltage and the saturated level-adjust voltage to obtain a liquid crystal capacitance value; and performing a simulation on the liquid crystal capacitance value to obtain an optimized level-adjust voltage.

6. The method of adjusting the brightness of a display device of claim 5, further comprises providing performing a computation on the display voltage to obtain a transparency rating.

7. The method of adjusting the brightness level of a display device of claim 5, wherein the saturated level-adjust voltage comprises a high voltage (Vsh) and a low voltage (Vsl).

8. A method of adjusting a brightness of a display device, comprising the steps of:

providing a saturated level-adjust voltage to a level adjustment of the display device when a central brightness is saturated, wherein the display device is driven with a dc voltage;

performing a computation of the saturated level-adjust voltage of each level adjustment to obtain a display voltage for each level adjustment;

performing a computation of the saturated level-adjust voltage, a common voltage and the display voltage of each level adjustment to obtain a feed-through voltage for each level adjustment;

performing a computation of the feed-through voltage and the saturated level- adjust voltage of each level adjustment to obtain a liquid crystal capacitance value for each level adjustment; and performing a simulation of the liquid crystal capacitance value of each level adjustment to obtain an optimized level-adjust voltage for each level adjustment.

* * * * *